United States Patent [19]

Kelly

[11] Patent Number: 4,487,527

[45] Date of Patent: Dec. 11, 1984

[54] SUBSEA WELLHEAD ASSEMBLY

[75] Inventor: Thomas P. Kelly, Houston, Tex.

[73] Assignee: Cameron Iron Works, Inc., Houston, Tex.

[21] Appl. No.: 409,369

[22] Filed: Aug. 19, 1982

[51] Int. Cl.[3] ..... E02D 31/00; E02D 31/14; E21B 33/03; F16L 37/00

[52] U.S. Cl. ..... 405/211; 405/217; 285/3; 166/368; 166/377

[58] Field of Search ..... 405/195, 211, 61, 217; 166/363–365, 368, 376, 377; 285/2–4

[56] References Cited

U.S. PATENT DOCUMENTS

| | | | |
|---|---|---|---|
| 2,562,298 | 7/1951 | Creighton | 285/3 X |
| 2,800,185 | 7/1957 | Teplitz | 166/377 X |
| 3,155,175 | 11/1964 | Johnson | 166/368 X |
| 3,662,822 | 5/1972 | Wakefield | 166/368 X |
| 3,971,576 | 7/1976 | Herd | 166/368 X |
| 4,080,797 | 3/1978 | Thompson | 405/217 |
| 4,183,404 | 1/1980 | James et al. | 166/363 X |
| 4,289,205 | 9/1981 | Mott | 166/377 |
| 4,290,483 | 9/1981 | Lawson | 285/3 X |

*Primary Examiner*—Cornelius J. Husar

*Assistant Examiner*—Nancy J. Stodola

*Attorney, Agent, or Firm*—Vinson & Elkins

[57] ABSTRACT

A subsea wellhead assembly for areas subject to iceberg scouring including an upper conductor in a well bore and a lower conductor in the well bore with the upper end of the lower conductor being within the lower end of the upper conductor and connected thereto by a weak connection and the upper end of the lower conductor being below the maximum iceberg scour depth and means for connecting said conductors, said connecting means having sufficient strength to withstand bending loads during drilling and being removable for installation of production equipment. Additionally production equipment in the well bore includes a block valve supported within the second conductor and a production string extending upward from the block valve and having a weak point within the upper end of the second conductor whereby the well control is not lost by deep iceberg scouring since the production control equipment is within the second conductor which is not damaged by the scouring and the production equipment extending thereabove fails without damage to the lower control equipment or loss of the well.

6 Claims, 4 Drawing Figures

SUBSEA WELLHEAD ASSEMBLY

BACKGROUND

Subsea wellheads in iceberg prone areas are susceptible to damage by iceberg scouring. Efforts have been made to protect such wellhead assemblies from iceberg scouring by excavating and placing the wellhead assembly in the excavation as shown in U.S. Pat. Nos. 3,461,951 and 3,952,263. In some cases covers, shields and anchor devices are used to protect the subsea wellhead as disclosed in U.S. Pat. No. 4,220,421.

Another prior art disclosure of a solution to solve iceberg scouring problems is suggested in the January 1980 issue of Ocean Industry page 19 et seq. in an article entitled "A Seasonal Oil Production Scheme for Iceberg infested Waters." A silo is lowered into a subsea excavation and the production Christmas tree is installed therein five meters below the mud line. The casings are hung in a caisson 17 meters below the bottom of the silo. A weak point is provided above the upper master valve " . . . as a safety measure in the improbable case where an iceberg would scour the bottom to a depth greater than the maximum depth foreseen, and would touch the silo or the top of the wellhead. The breakage of the weak point in this case, would assure the integrity of the two master valve blocks and, therefore, the safety of the well." Such weak point is in the production lines above the upper block valves.

One problem not considered in these prior attempts to preserve a subsea well that has been subject to a deep iceberg damage is that merely providing for a weak point in the production lines may not preserve the well when the conductor pipe is damaged.

SUMMARY

The present invention relates to an improved wellhead assembly for a subsea well having an anchor base on the bottom surrounding the well bore of the well, a first conductor in the well bore connected to the anchor base, a second conductor having its upper end within the lower end of the first conductor, said anchor base, and said conductors being cemented in said well bore, means for sealing between the upper end of the second conductor and the lower end of the first conductor and means for supporting the second conductor from the upper end of the first conductor and such supporting means having adequate bending load capacity during drilling and being removed for well production equipment which has a weak point to release under deep iceberg scouring so that the first conductor and the production tubing break away and the second conductor remains in the well bore.

An object of the present invention is to provide an improved subsea wellhead assembly which when subjected to iceberg scouring, breaks at a preselected location leaving the equipment below the break in the well bore undamaged.

Another object is to provide an improved subsea wellhead assembly which when subjected to iceberg scouring breaks in a manner and location to maintain control of the well and provide quick and simple reinstallation of completion equipment.

Still another object is to provide a subsea wellhead structure with a weak point and which structure is sufficiently strong to withstand bending loads encountered during drilling without damaging the structure at its weak point.

BRIEF DESCRIPTION OF THE DRAWINGS

These and other objects, features and advantages of the present invention are hereinafter set forth and explained with reference to the drawings wherein.

DESCRIPTION OF THE PREFERRED EMBODIMENT

Figure 1:
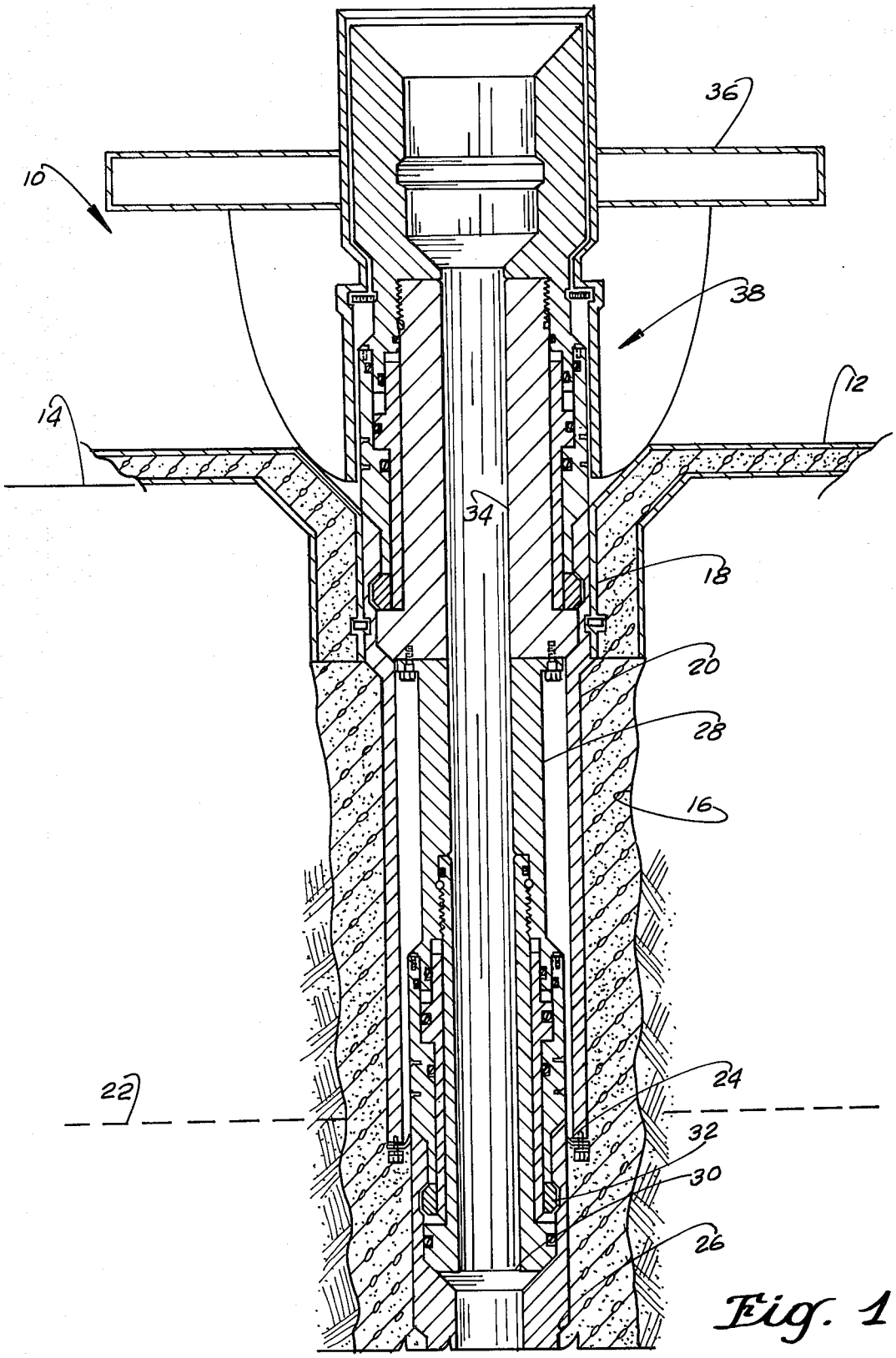
FIG. 1 is a sectional view of a subsea wellhead assembly of the present invention during drilling.

Subsea wellhead assembly 10 shown in FIG. 1 includes anchor base 12 seated on the bottom 14 in surrounding relation to well bore 16 and has its neck 18 extending into well bore 16. Upper conductor 20 is positioned in well bore 16 has its upper end within neck 18 of anchor base 12 and extends downward to a position below the maximum predicted scour depth 22. Upper conductor 20 can be a large conductor pipe having a diameter as large as forty inches. Seal 24 extends inwardly at the lower end of upper conductor 20 to engage around the upper exterior of lower conductor 26. Tie back spool 28 is positioned on internal seat 30 in conductor 26 and is latched to conductor 26 by lower latching connector 32. Spool 28 is connected to upper latching connector 34 which is connected to guide base 36 and upper latching connector 34 latches guide base 36 and tieback spool 28 to the upper interior of upper conductor 20. When such structure is in position within well bore cement is pumped down and flows upward filling the annulus between the exterior of such equipment and well bore 16. Seal 24, being resilient, prevents cement from flowing out between conductors 20 and 26. Anchor base 12 is preferably vented to direct cement away from the well to avoid overflow accumulation at the guide base 36. During drilling the connection of spool 28 and connector 34 provide sufficient strength spanning the joint between conductors 20 and 26 to withstand normal bending loads exerted on conductor 20.

Figure 2:
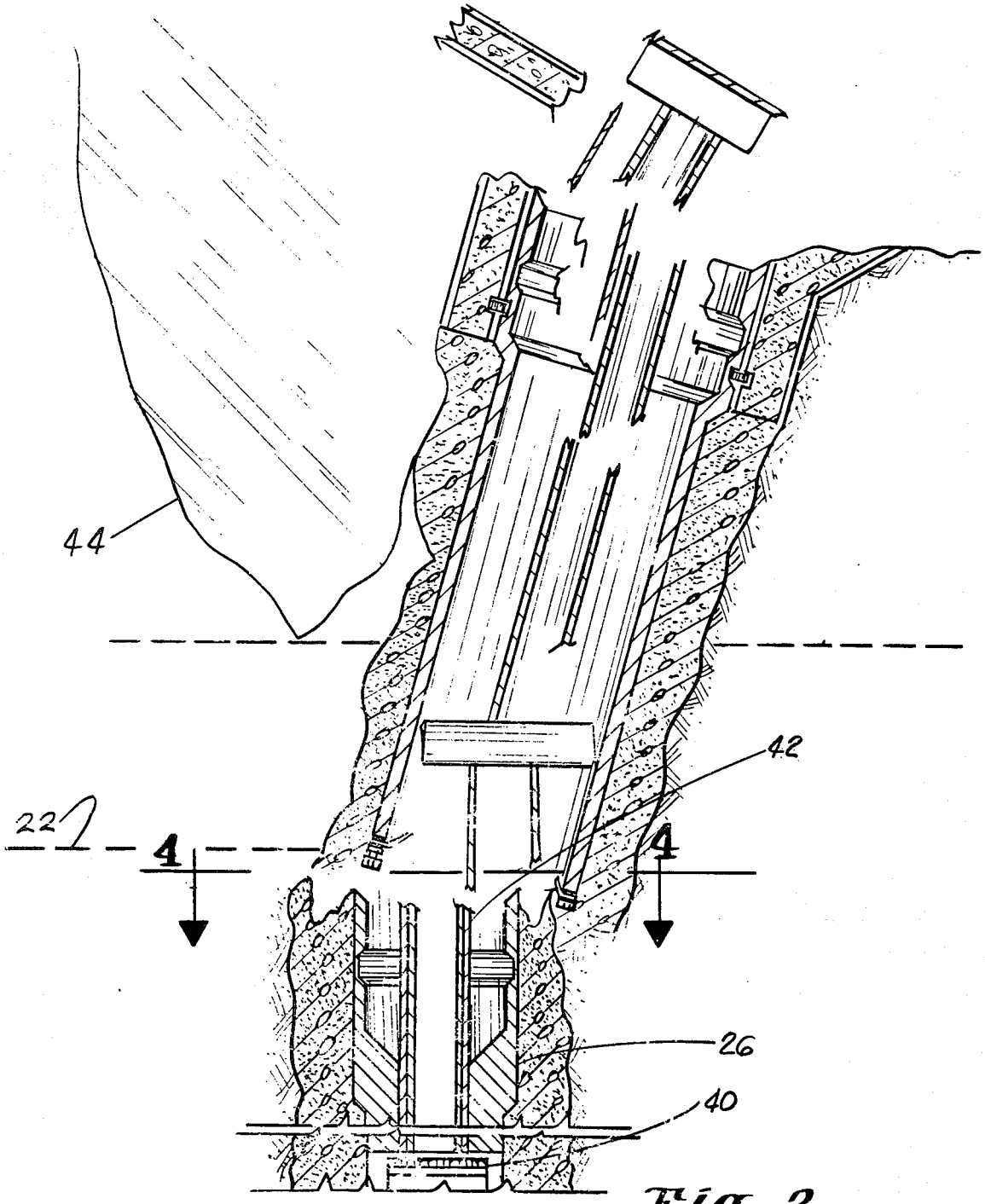
FIG. 2 is a sectional view illustrating the damage of iceberg scouring on the subsea wellhead after completion equipment is run and landed.
Figure 3:
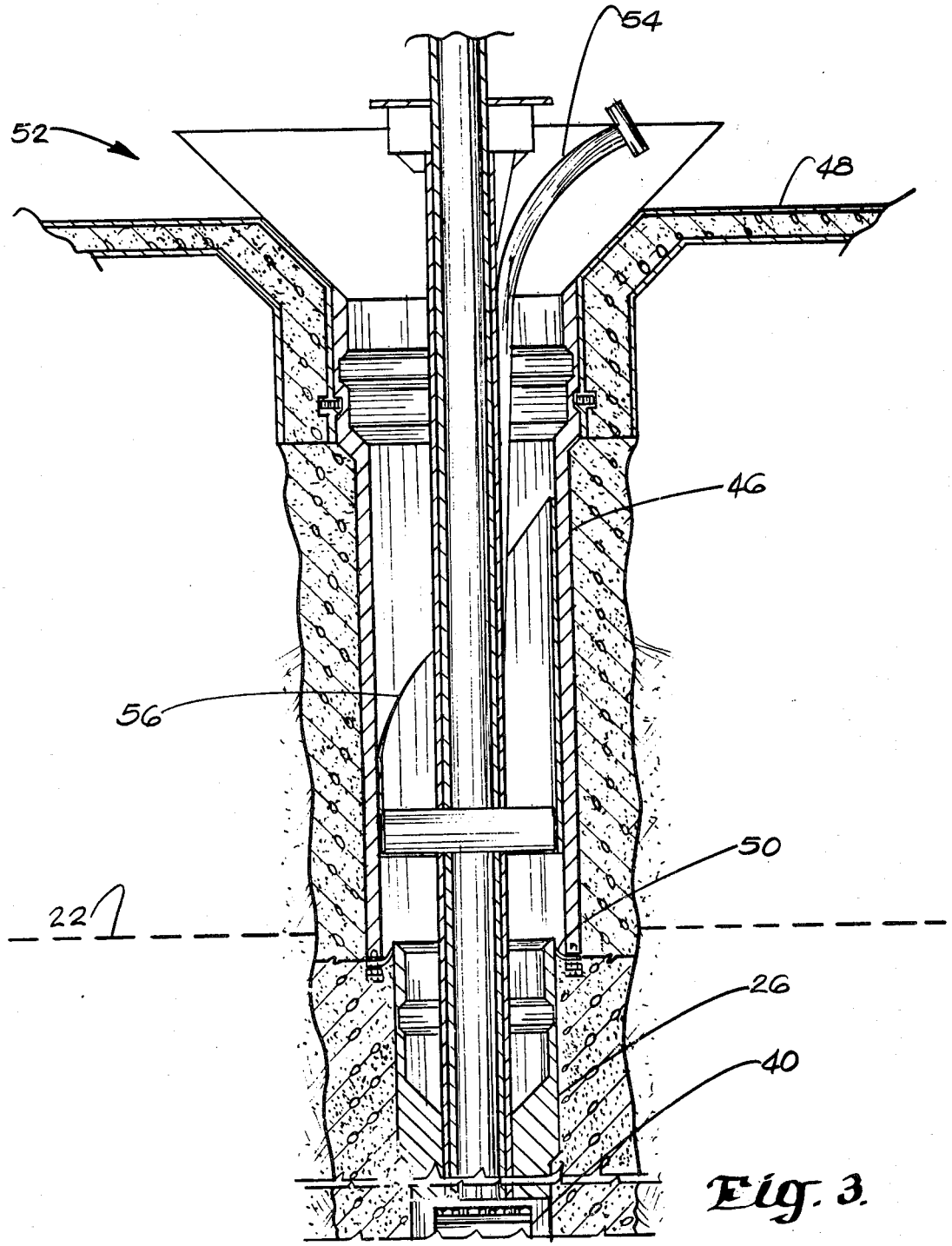
FIG. 3 is a sectional view of the reconnection to the damaged wellhead.
Figure 4:
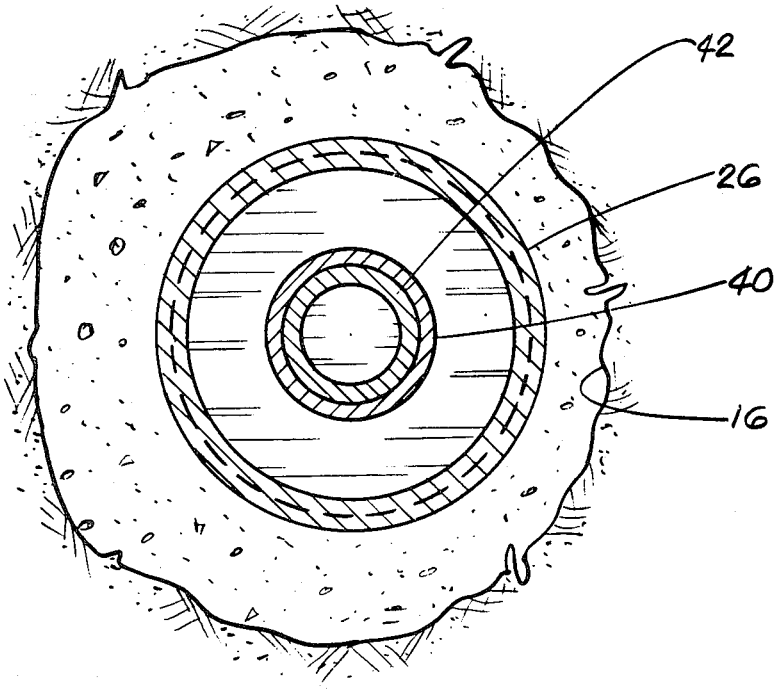
FIG. 4 is a sectional view taken along line 4—4 in FIG. 2 of the scoured wellhead to show the conductor remaining in the well bore.

With the structure cemented in place drilling proceeds therethrough. When drilling is completed, standard caisson completion concepts are used. After the tubing assembly (not shown) is installed and the well is made safe, the blowout preventer stack and the tie-back spool are retrieved. A running tool (not shown) is used to retrieve latching connector 34, tie-back spool 28, guide base 36, and latching connector 32 as a single unit. The caisson valve block 40, the flowline string 42 and the flowline connector structure (not shown) are installed. Production equipment is shown in FIG. 2 with upper block valve 40 being positioned within lower conductor 26 and production string 42 is weakened at a point within lower conductor 26. With connectors 32 and 34 and spool 28 removed the only connection between conductors 20 and 26 is the cement. Seal 24 is positioned to prevent any substantial amount of cement from entering the annulus area between the two conductors and thus provides a joint which allows conductor 20 to be scoured away without disturbing conductor 26.

Thus, when wellhead production equipment is subjected to scouring by iceberg 44, production string 42 breaks above block valve 40 and upper conductor 20 is scoured away as shown in FIG. 2 leaving lower conductor 26 in place. Such breaking away of the wellhead production equipment provides a clean break without losing control of the well and allowing reconnection into the well with replacement equipment easily and quickly.

Once the scoured well is located and the debris cleared away a new conductor 46 and anchor base 48 are lowered into surrounding relation to the upper end of conductor 26. Flexible seal 50 is secured on the lower end of conductor 46. Production equipment 52 including production string 54 is landed in conductor 46 and string 54 is connected to block valve 46 to reestablish production. Mule shoe 56 is positioned in conductor 46 to assist in landing control equipment and production string 54 in their desired position.

What is claimed is:

1. A subsea wellhead assembly adapted to be installed on the floor of the ocean in an area having a maximum predicted iceberg scour depth comprising an anchor base on the floor of the ocean surrounding a well bore, a first conductor having an upper end and a lower end, said upper end being connected to the anchor base and said lower end extending therebelow into the well bore, said first conductor having its lower end in the well bore below the anchor base and below the maximum predicted iceberg scour depth, and a second conductor cemented in said well bore below said first conductor and having an upper end positioned within said lower end of said first conductor, the upper end of said second conductor being positioned below the maximum predicted iceberg scour depth, said first conductor being cemented in said well bore with its lower end surrounding only the upper end of said second conductor and being retained in such position by the cement so that iceberg scouring of said first conductor causes it to be disengaged from the second conductor with the upper end of the second conductor remaining in position ready for re-entry and re-connection.

2. A subsea wellhead assembly according to claim 1 including a flexible seal means for sealing between the lower end of said first conductor and the upper end of said second conductor.

3. A subsea wellhead assembly according to claim 1 wherein said second conductor includes an internal profile means to engage connecting means to support said second conductor in the well bore during cementing.

4. A subsea wellhead assembly according to claim 1 including production equipment mounted in the well bore including a block valve supported in said second connector.

5. A subsea wellhead assembly according to claim 4 wherein said production equipment includes a production string connecting to said block valve and having a weak point above said block valve and within said second conductor whereby iceberg scouring causes said production string to break above said block valve at a level within said second conductor.

6. A subsea wellhead assembly adapted to be installed on the floor of the ocean in an area having a maximum predicted iceberg scour depth comprising an anchor base on the floor of the ocean surrounding a well bore, a first conductor having an upper end and a lower end, said upper end being connected to said anchor base and said lower end extending therebelow into the well bore, a second conductor being of smaller diameter than said first conductor, having an upper end, and being cemented into the well bore with said upper end within said lower end of said first conductor, means sealing between the lower end of said first conductor and the exterior of the upper end of said second conductor, and means for connecting between the first and second conductors to withstand bending loads during drilling, said connecting means being removable after completion of drilling, the upper end of said second conductor being positioned below said maximum predicted iceberg scour depth whereby iceberg scour damage to the wellhead assembly does not damage the upper end of said second conductor.

* * * * *